US009724924B2

(12) United States Patent
Yamanobe et al.

(10) Patent No.: US 9,724,924 B2
(45) Date of Patent: Aug. 8, 2017

(54) WIPING MECHANISM, LIQUID DROPLET JETTING APPARATUS, AND WIPING METHOD

(71) Applicant: FUJIFILM Corporation, Tokyo (JP)

(72) Inventors: Jun Yamanobe, Kanagawa (JP); Hiroshi Mataki, Kanagawa (JP); Hiroshi Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/407,351

(22) Filed: Jan. 17, 2017

(65) Prior Publication Data

US 2017/0120600 A1 May 4, 2017

(30) Foreign Application Priority Data

Sep. 25, 2014 (JP) ..... 2014-195594

(51) Int. Cl.
*B41J 2/165* (2006.01)

(52) U.S. Cl.
CPC ..... *B41J 2/16535* (2013.01); *B41J 2/16544* (2013.01); *B41J 2002/1655* (2013.01); *B41J 2002/16558* (2013.01)

(58) Field of Classification Search
CPC ..... B41J 2/16535; B41J 2/16544; B41J 2002/1655; B41J 2002/16558
See application file for complete search history.

(56) References Cited

U.S. PATENT DOCUMENTS

| | | | | |
|---|---|---|---|---|
| 8,480,204 | B2 | 7/2013 | Fukasawa et al. | |
| 2004/0223029 | A1 | 11/2004 | Nishino | |
| 2011/0199419 | A1* | 8/2011 | Hayashi | B41J 2/155 347/19 |
| 2014/0198156 | A1 | 7/2014 | Murayama et al. | |

FOREIGN PATENT DOCUMENTS

| | | | | |
|---|---|---|---|---|
| JP | 2-198859 | * | 7/1990 | B41J 2/175 |
| JP | H02-198859 | A | 8/1990 | |
| JP | 2004-322460 | A | 11/2004 | |

(Continued)

OTHER PUBLICATIONS

International Search Report issued in PCT/JP2015/063487; dated Jul. 28, 2015.

(Continued)

*Primary Examiner* — Manish S Shah
*Assistant Examiner* — Yaovi M Ameh
(74) *Attorney, Agent, or Firm* — Studebaker & Brackett PC

(57) ABSTRACT

Provided are a wiping mechanism, a liquid droplet jetting apparatus, and a wiping method capable of securing an absorption capacity of a wiping member which absorbs a liquid adhered to a nozzle surface while preventing infiltration of bubbles into a nozzle when the nozzle surface is wiped by the wiping member. The nozzle surface is wiped by the wiping member which has one surface 200A that comes into contact with the nozzle surface in which a plurality of nozzles through which liquid droplets are jetted are formed, and has a plurality of voids M that form capillaries from the one surface 200A side to the other surface 200B side, the voids M being greater in size on the other surface 200B side than on the one surface side 200A among the plurality of voids M.

14 Claims, 6 Drawing Sheets

(56) References Cited

FOREIGN PATENT DOCUMENTS

| | | | |
|---|---|---|---|
| JP | 2008-137266 | A | 6/2008 |
| JP | 2011-161845 | A | 8/2011 |
| JP | 2011-161854 | A | 8/2011 |
| JP | 2011-161856 | A | 8/2011 |
| JP | 2013-169761 | A | 9/2013 |
| JP | 2014-133386 | A | 7/2014 |

OTHER PUBLICATIONS

Written Opinion issued in PCT/JP2015/063487; dated Jul. 28, 2015.
International Preliminary Report on Patentability issued in PCT/JP2015/063487; dated Dec. 15, 2015.

* cited by examiner

WIPING MECHANISM, LIQUID DROPLET JETTING APPARATUS, AND WIPING METHOD

CROSS-REFERENCE TO RELATED APPLICATIONS

This application is a Continuation of PCT International Application No. PCT/JP2015/063487 filed on May 11, 2015, which claims priority under 35 U.S.C. §119 (a) to Japanese Patent Application No. 2014-195594 filed on Sep. 25, 2014. Each of the above application(s) is hereby expressly incorporated by reference, in its entirety, into the present application.

BACKGROUND OF THE INVENTION

1. Field of the invention

The present invention relates to a wiping mechanism, a liquid droplet jetting apparatus, and a wiping method.

2. Description of the Related Art

A technique for wiping a nozzle surface of an ink jet head with a wiping member for maintenance of the ink jet head is known (refer to JP2008-137266A).

In the configuration of JP2008-137266A, by using a cleaning sheet having a double layer structure as the wiping member, the nozzle surface is wiped while a cleaning liquid is applied to a surface layer of the cleaning sheet, which has a large volume per unit area, and thereafter dry wiping is performed with a rear layer on the opposite side.

SUMMARY OF THE INVENTION

Here, in the configuration in which the nozzle surface is wiped by the wiping member, when the nozzle surface is wiped by the wiping member, if bubbles infiltrate into the nozzle formed at the nozzle surface, there may be cases where ink jetting failure (non-jetting, bending in the jetting direction, and the like) occurs due to the nozzle into which bubbles infiltrate. When such jetting failure occurs, there may be cases where image failure such as streaks occurs in an image formed on a recording medium such as a sheet. In addition, in a case where a purging operation of discharging ink from all the nozzles is performed in order to remove bubbles in the ink, thickened ink, and the like, a large amount of ink adheres to the nozzle surface. Therefore, the wiping member requires an absorption capacity (absorption ability) capable of absorbing a large amount of liquid.

An object of the present invention is to secure an absorption capacity of a wiping member which absorbs a liquid adhered to a nozzle surface while preventing infiltration of bubbles into a nozzle when the nozzle surface is wiped by the wiping member.

According to a first aspect of the present invention, a wiping mechanism comprises: a wiping member which has one surface that comes into contact with a nozzle surface with a nozzle through which liquid droplets are jetted, and has a plurality of voids that form capillaries from the one surface side to the other surface side, the voids being greater in size on the other surface side than on the one surface side; and a moving mechanism which moves the wiping member relative to the nozzle surface.

In the wiping mechanism according to the first aspect, as the moving mechanism moves the wiping member of which the one surface comes into contact with the nozzle surface relative to the nozzle surface, the one surface of the wiping member wipes the nozzle surface. A liquid absorbed by the one surface of the wiping member due to the voids that form capillaries from the one surface side to the other surface side moves toward the voids positioned on the other surface side.

Here, in the wiping mechanism according to the first aspect, the voids positioned on the one surface side of the wiping member that comes into contact with the nozzle surface are smaller in size than the voids positioned on the other surface side. Therefore, compared to a case where the size of the voids on the one surface side is equal to or greater than the size of the voids on the other surface side, the suction force acting on the liquid in the nozzle decreases. Accordingly, the liquid in the nozzle is not absorbed more than necessary, and infiltration of bubbles into the nozzle can be prevented.

In addition, in the wiping mechanism according to the first aspect, since the voids on the other surface side are greater in size than the voids on the one surface side, compared to a case where the size of the voids on the other surface side is equal to or smaller than the size of the voids on the one surface side, a large amount of the liquid moved from the one surface side can be absorbed.

As described above, in the wiping mechanism according to the first aspect, while infiltration of bubbles into the nozzle is prevented when the nozzle surface is wiped by the wiping member, the absorption capacity of the wiping member which absorbs the liquid adhered to the nozzle surface can be secured.

According to a second aspect of the present invention, in the wiping mechanism, the wiping member has a single layer structure.

In the wiping mechanism according to the second aspect, since the wiping member has a single layer structure, there is no boundary between layers, unlike a multi-layer structure. Therefore, a significant change in the suction force of the liquid, which occurs at the boundary in a case where the liquid is suctioned from the one surface side toward the other surface side beyond the boundary in the case of the multi-layer structure, does not occur. Therefore, the suction force acting on the liquid in the nozzle is maintained at a low level, so that infiltration of bubbles into the nozzle can be prevented.

According to a third aspect of the present invention, in the wiping mechanism, the wiping member is formed by weaving yarn bundles configured by binding yarns, the yarn bundles on the other surface side are bound together more densely than the yarn bundles on the one surface side, and the voids between the yarn bundles are greater in size on the other surface side than on the one surface side.

In the wiping mechanism according to the third aspect, by causing methods of binding yarn bundles to be different between the yarn bundles on the other surface side and the yarn bundles on the one surface side, the sizes of the voids are adjusted. Therefore, with a simple configuration, the sizes of the voids on the one surface side and on the other surface side of the wiping member can be caused to be different from each other.

According to a fourth aspect of the present invention, the wiping mechanism further comprises: a measuring part which measures the amount of liquid adhered to the wiping member that has wiped the nozzle surface; and a notification part which notifies predetermined notification to a user of an apparatus in a case where the amount of the liquid measured by the measuring part is equal to or more than a specified amount.

Here, when the liquid is absorbed from the nozzle, bubbles infiltrate into the space where the liquid is not present in the nozzle. Accordingly, as the amount of the liquid. absorbed from the nozzle increases, there is a higher possibility of infiltration of bubbles into the nozzle. In addition, the amount of the liquid absorbed from the nozzle is proportional to the amount of the liquid adhered to the wiping member which wipes the nozzle surface. Therefore, in a case where the amount of the liquid adhered to the wiping member which wipes the nozzle surface is equal to or more than a specified amount, it is understood that there is a high possibility of infiltration of bubbles into the nozzle.

In addition, as in the wiping mechanism according to the fourth aspect, in a case where the amount of the liquid adhered to the wiping member which wipes the nozzle surface is equal to or more than the specified amount, the possibility of infiltration of bubbles into the nozzle can be notified to the user of the apparatus by notifying predetermined notification to the user of the apparatus.

According to a fifth aspect of the present invention, a liquid droplet jetting apparatus comprises: a liquid droplet jetting head having a nozzle surface with a nozzle through which liquid droplets are jetted; and the wiping mechanism described in any one of the first to fourth aspects, which wipes the nozzle surface of the liquid droplet jetting head with the wiping member.

In the liquid droplet jetting apparatus according to the fifth aspect, since infiltration of bubbles into the nozzle can be prevented by the wiping mechanism according to any one of the first to fourth aspects, liquid droplet jetting failure caused by the infiltration of bubbles into the nozzle of the liquid droplet jetting head can be prevented. In addition, since the absorption capacity of the wiping member which wipes the nozzle surface is secured, unwiped portions of the nozzle surface of the liquid droplet jetting head can be prevented.

According to a sixth aspect of the present invention, the liquid droplet jetting apparatus has a wiping mode in which the nozzle surface is wiped by moving the wiping member relative to the nozzle surface, and a purge wiping mode in which a purging operation of jetting a liquid from all the nozzles is performed, and after the purging operation is performed, the nozzle surface is wiped by moving the wiping member relative to the nozzle surface.

As described above, the liquid droplet jetting apparatus according to the sixth aspect has the purge wiping mode in which the purging operation and the operation of wiping the nozzle surface are performed, separately from the wiping mode in which the nozzle surface is wiped.

In the purge wiping mode, since the nozzle surface is wiped after the purging operation is performed, the liquid adhered to the nozzle surface can be suitably removed by the purging operation.

According to a seventh aspect of the present invention, a wiping method comprises: moving a wiping member, which has one surface that comes into contact with a nozzle surface with a nozzle through which liquid droplets are jetted, and has a plurality of voids that form capillaries from the one surface side to the other surface side, the voids being greater in size on the other surface side than on the one surface side, relative to the nozzle surface.

In the wiping method according to the seventh aspect, the same actions and effects as those of the wiping mechanism according to the first aspect are exhibited.

According to an eighth aspect of the present invention, in the wiping method, the wiping member which has a single layer structure is used.

In the wiping method according to the eighth aspect, the same actions and effects as those of the wiping mechanism according to the second aspect are exhibited.

According to a ninth aspect of the present invention, in the wiping method, the wiping member in which the wiping member is formed by weaving yarn bundles configured by binding yarns, the yarn bundles on the other surface side are bound together more densely than the yarn bundles on the one surface side, and the voids between the yarn bundles are greater in size on the other surface side than on the one surface side, is used.

In the wiping method according to the ninth aspect, the same actions and effects as those of the wiping mechanism according to the third aspect are exhibited.

According to the present invention, an absorption capacity of the wiping member which absorbs the liquid adhered to the nozzle surface can be secured while preventing infiltration of bubbles into the nozzle when the nozzle surface is wiped by the wiping member.

DESCRIPTION OF THE PREFERRED EMBODIMENTS

Hereinafter, an example of an embodiment according to the present invention will be described with reference to the drawings.

(Configuration of Liquid Droplet Jetting Apparatus 10)

Figure 1:
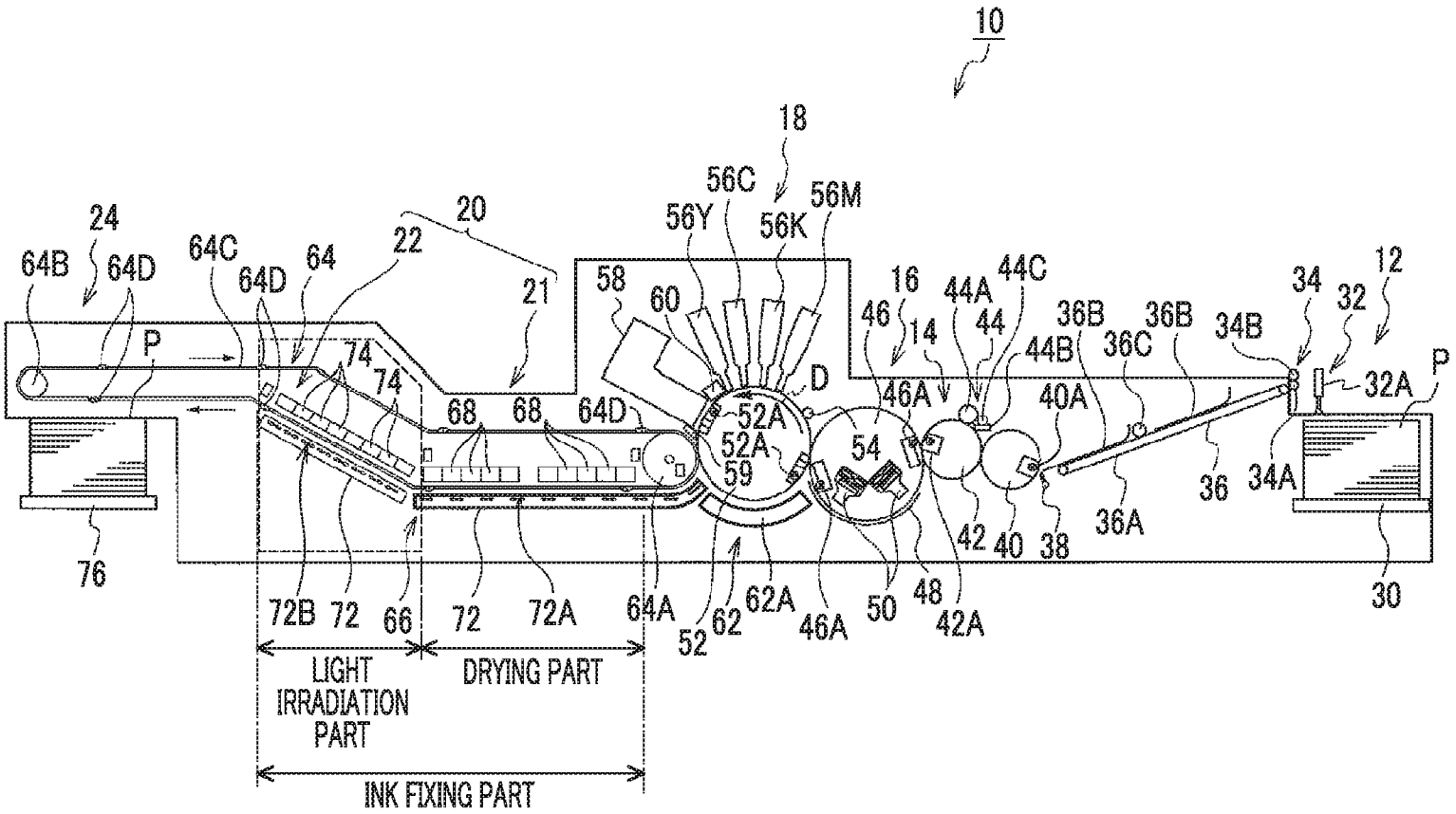
FIG. 1 is a schematic view illustrating a liquid droplet jetting apparatus according to an embodiment.

First, the configuration of the liquid droplet jetting apparatus 10 will be described. FIG. 1 is a schematic view illustrating the configuration of the liquid droplet jetting apparatus 10 according to this embodiment.

As illustrated in FIG. 1, the liquid droplet jetting apparatus 10 according to this embodiment is configured to record (form) an image on a recording medium (for example, sheet) P as a jetting object using a photocurable ink (for example, ultraviolet curable ink using an aqueous medium) as an example of a liquid in an ink jet manner. The liquid droplet jetting apparatus 10 includes, as main parts, a feeding part 12 which feeds the recording medium P, a processing liquid adding part 14, a processing liquid drying part 16, an image recording part 18, an ink fixing part 20 as ink fixing means including a drying part 21 and a light irradiation part 22, control means (not illustrated) responsible for control of the entire system, and a discharge part 24 which discharges the recording medium P.

(Feeding Part 12)

The feeding part 12 is configured to feed the recording media P stacked on a feeding table 30 to the processing liquid adding part 14 one by one. The feeding part 12 is mainly constituted by the feeding table 30, a sucker device 32, a feeding roll pair 34, a feeder board 36, a front guard 38, and a feeding drum 40.

A large number of the recording media P are loaded on the feeding table 30 in a state of being stacked as a bundle. The feeding table 30 is provided so as to he elevated by a feeding table elevating device (not illustrated). The feeding table elevating device is controlled to be driven in conjunction with variation in the recording media P stacked on the feeding table 30, and is configured so that the feeding table 30 is elevated to cause the recording medium P at the uppermost position of the bundle to be always at a constant height.

In the sucker device 32, the recording media P stacked on the feeding table 30 are picked up one by one in order from above and are fed to the feeding roll pair 34. The sucker device 32 includes a suction foot 32A provided to be elevated and oscillated. The upper surface of the recording medium P is adsorbed and held by the suction foot 32A and the recording medium P is transported to the feeding roll pair 34 from the feeding table 30. At this time, the suction foot 32A is configured to adsorb and hold the upper surface of the leading end side of the recording medium P positioned at the uppermost position of the bundle so as to cause the recording medium P to be pulled upward, and to cause the leading end of the recording medium P pulled upward to be inserted between a pair of rolls 34A and 34B constituting the feeding roll pair 34.

One of the rolls 34A and 34B is a driving roll (for example, the roll 34A), and the other thereof is a driven roll (for example, the roll 34B). The driving roll is connected to a motor (not illustrated) and is driven to rotate by the rotation of the motor. The motor is driven in conjunction with the feeding of the recording medium P, and when the recording medium P is fed from the sucker device 32, the motor rotates the driving roll according to the timing. The recording medium P inserted between the pair of rolls 34A and 34B is nipped between the rolls 34A and 34B and is sent out in an installation direction of the feeder board 36.

The feeder board 36 is formed to correspond to the recording medium width and is configured to guide the recording medium P sent out from the feeding roll pair 34 to the front guard 38. The feeder board 36 is provided to be inclined downward, and the recording medium P placed on a transport surface of a transport path of the feeder board 36 slides along the transport surface and is guided to the front guard 38.

In the feeder board 36, a plurality of tape feeders 36A which transport the recording medium P and have the transport direction as the longitudinal direction are provided with intervals therebetween in the width direction. The tape feeder 36A is formed in an endless shape and is configured to rotate by a motor (not illustrated) as a driving source. The recording medium P placed on the transport surface of the feeder board 36 is transported on the feeder board 36 by the tape feeders 36A.

In addition, on the feeder board 36, retainers 36B and a roller 36C are provided. A plurality of (in this embodiment, two) the retainers 36B are arranged in tandem in the front and rear along, the transport surface of the recording medium P. The retainer 36B is configured as a plate spring having a width corresponding to the recording medium width and comes into pressing contact with the transport surface. As the recording medium P transported on the feeder board 36 by the tape feeders 36A passes through the retainers 36B, unevenness of the recording medium P is corrected. The roller 36C is disposed between the retainer 36B disposed on the upstream side in the transport direction and the retainer 36B on the downstream side. The roller 36C comes in pressing contact with the transport surface of the recording medium P. The recording medium P transported between the retainers 36B is transported while the upper surface thereof is pressed by the roller 36C.

The front guard 38 is configured to correct the posture of the recording medium P. The front guard 38 is formed in a plate shape, and the plate-like surface thereof is disposed to be perpendicular to the transport direction of the recording medium P. In addition, the front guard 38 is connected to a motor (not illustrated), and is driven by the motor so as to be oscillated. At a time point at which the leading end of the recording medium P transported on the feeder board 36 abuts the front guard 38, the transporting posture of the recording medium P is corrected (so-called skew prevention is performed). The front guard 38 is oscillated in conjunction with feeding of the recording medium P to the feeding drum 40, and the recording medium P of which the transporting posture is corrected is delivered to the feeding drum 40.

The feeding drum 40 receives the recording medium P fed from the feeder board 36 via the front guard 38 and transports the recording medium P to the processing liquid adding part 14. The feeding drum 40 is formed in a cylindrical shape, and is configured to be connected to a motor (not illustrated) and be rotated by driving of the motor. A gripper 40A is provided on the outer circumferential surface of the feeding drum 40, and the leading end of the recording medium P is gripped by the gripper 40A. As the gripper 40A grips and rotates the leading end of the recording medium P, the feeding drum 40 transports the recording medium P to the processing liquid adding part 14 while winding the recording medium P around the circumferential surface.

(Processing Liquid Adding Part 14)

The processing liquid adding part 14 adds a processing liquid to the surface (image recording surface) of the recording medium P. The processing liquid adding part 14 is mainly constituted by a processing liquid adding drum 42 which transports the recording medium P, and a processing liquid adding unit 44 which adds the processing liquid to the image recording, surface of the recording medium P transported by the processing liquid adding drum 42. The processing liquid added to the surface of the recording medium P is an aggregating agent having a function of causing a coloring material (pigment) in the photocurable ink jetted onto the recording medium P by the image recording part 18 disposed on the downstream side in the transport direction, to collect.

The processing liquid adding drum 42 transports the recording medium P transported from the feeding drum 40 of the feeding part 12 to the processing liquid drying part 16. The processing liquid adding drum 42 is formed in a cylindrical shape, and is configured to be connected to a motor (not illustrated) and be driven by the rotation of the motor. Gripper 42A are provided on the outer circumferential surface of the processing liquid adding drum 42, and the gripper 42A is configured to grip the leading end of the recording medium P. As the gripper 42A grips and rotates the leading end of the recording medium P, the processing liquid adding drum 42 transports the recording medium P to the processing liquid drying part 16 while winding the recording medium P around the circumferential surface. When the processing liquid adding drum 42 rotates once, a single recording medium P is transported. Rotation of the processing liquid adding drum 42 and the feeding drum 40 is controlled so as to cause reception and delivery timings of the recording medium P of the two to be coincident with each other. That is, the processing liquid adding drum 42 and the feeding drum 40 are driven while causing the circumferential speeds of the two to be coincident with each other and are driven while causing the positions of the grippers 40A and 42A of the two to be coincident with each other.

In the processing liquid adding unit 44, the processing liquid is applied by rolls to the surface of the recording medium P transported by the processing liquid adding drum 42. The processing liquid adding unit 44 is mainly constituted by an application roll 44A which applies the processing liquid to the recording medium P, a processing liquid tank 44B which stores the processing liquid, and a drawing roll 44C which draws the processing liquid stored in the processing liquid tank 44B and supplies the processing liquid to the application roll 44A.

(Processing Liquid Drying Part 16)

In the processing liquid drying part 16, the recording medium P having the processing liquid added to the surface thereof is dried. The processing liquid drying part 16 is mainly constituted by a processing liquid drying drum 46 which transports the recording medium P, a sheet transport guide 48, and a processing liquid drying unit 50 which blows dry wind toward the image recording surface of the recording medium P transported by the processing liquid drying drum 46 so as to be dried.

The processing liquid drying drum 46 is configured to receive the recording medium P from the processing liquid adding drum 42 of the processing liquid adding part 14 and transport the recording medium P to the image recording part 18. The processing liquid drying drum 46 is configured as a frame body assembled in a cylindrical shape, is connected to a motor (not illustrated), and is driven by rotation of the motor. A grippers 46A is provided on the outer circumferential surface of the processing liquid drying drum 46, and the leading end of the recording medium P is gripped by the gripper 46A. As the gripper 46A grips and rotates the leading end of the recording medium P, the processing liquid drying drum 46 transports the recording medium P to the image recording part 18. In addition, in the processing liquid drying drum 46 in this embodiment, the grippers 46A are disposed at two points on the outer circumferential surface and are configured to transport two recording media P by one rotation. Rotation of the processing liquid drying drum 46 and the processing liquid adding drum 42 is controlled so as to cause reception and delivery timings of the recording medium P of the two to be coincident with each other. That is, the processing liquid drying drum 46 and the processing liquid adding drum 42 are driven while causing the circumferential speeds of the two to be coincident with each other and are driven while causing the positions of the grippers 42A and 46A thereof to be coincident with each other.

The sheet transport guide 48 is disposed around the outer periphery of the processing liquid drying drum 46 along the transport path of the recording medium P. The sheet transport guide 48 guides the recording medium P so as not to deviate from the processing liquid drying drum 46 (transport path).

The processing liquid drying unit 50 is installed on the inside of the processing liquid drying drum 46, and is configured to blow dry wind toward the surface of the recording medium P transported by the processing liquid drying drum 46 so as to be dried. Accordingly, solvent components in the processing liquid are removed, and an ink aggregating layer is formed on the surface of the recording medium P. In this embodiment, two processing liquid drying units 50 are disposed in the processing liquid drying drum 46 and are configured to blow dry wind toward the surface of the recording medium P transported by the processing liquid drying drum 46.

(Image Recording Part 18)

The image recording part 18 is configured to record a color image on an image formation surface of the recording medium P by jetting ink droplets (an example of liquid droplets) of the photocurable ink with M, K, C, and Y colors onto the image recording surface of the recording medium P. The image recording part 18 is mainly constituted by an image recording drum 52 which transports the recording medium P, a recording medium pressing roll 54 which causes the recording medium P to come into close contact with the circumferential surface of the image recording drum 52 by pressing the recording medium P transported by the image recording drum 52, ink jet heads 56M, 56K, 56C, and 56Y which jet ink droplets with M, K, C, and Y colors onto the recording medium P, an inline sensor 58 which reads the image recorded on the recording medium P, a mist filter 60 which captures ink mist, and a drum cooling unit 62. In addition, as described above, as the ink jetted from the ink jet heads 56M, 56K, 56C, and 56Y, the photocurable ink is used. The photocurable ink is cured by being irradiated with light (ultraviolet rays) by the ink fixing means, which will be described later and is thus dried. In the following description, in a case where there is no need to distinguish magenta (M), black (K), cyan (C), and yellow (Y) from each other, M, K, C, and Y attached to reference numerals are omitted.

Figure 3:
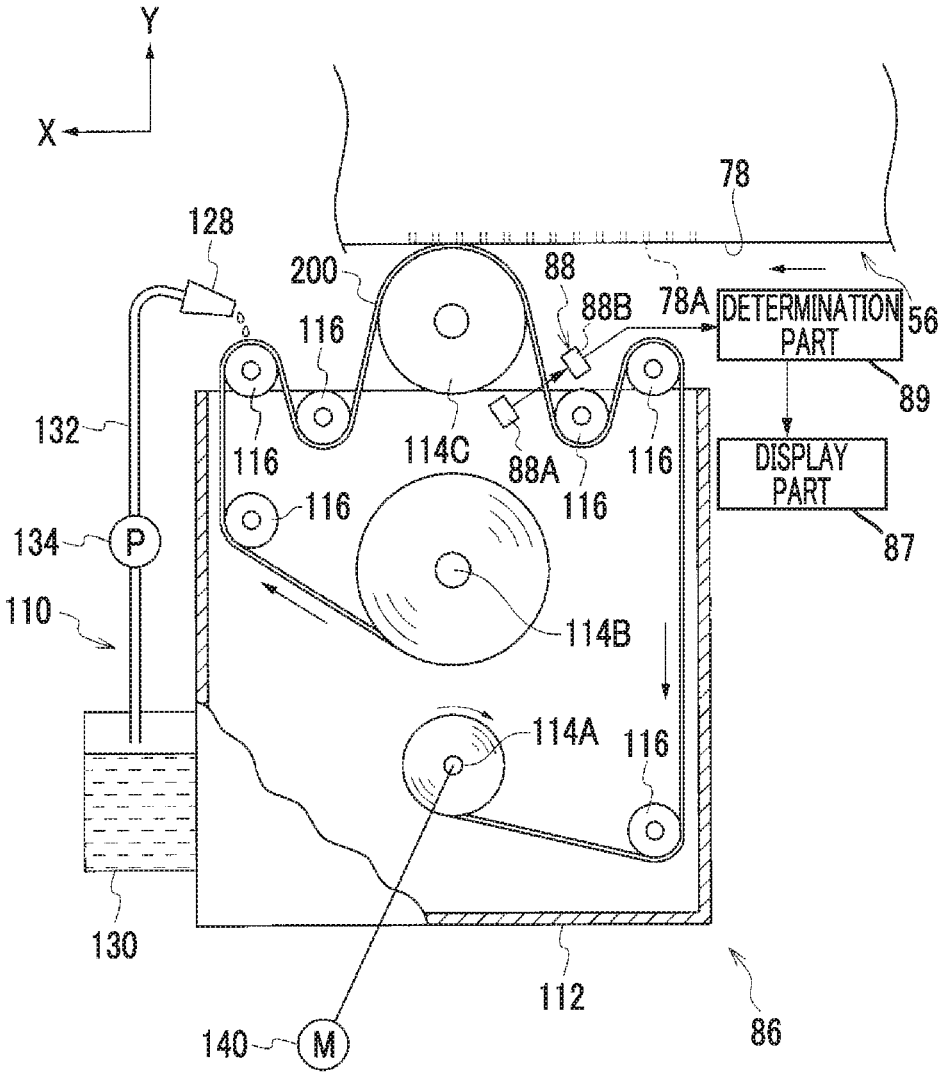
FIG. 3 is a view illustrating a wiping unit according to the embodiment.

The ink jet head 56 (an example of a liquid droplet jetting head) has a nozzle surface 78 in which a plurality of nozzles 78A through which ink droplets are jetted (see FIG. 3).

The image recording drum 52 is configured to receive the recording medium P from the processing liquid drying drum 46 of the processing liquid drying part 16 and transport the recording medium P to an ink fixing part 20. The image recording drum 52 is formed in a cylindrical shape, is connected to a motor (not illustrated), and is driven by rotation of the motor. Grippers 52A are provided on the outer circumferential surface of the image recording drum 52, and the leading end of the recording medium P is gripped by the gripper 52A. As the gripper 52A grips and rotates the leading end of the recording medium P, the image recording drum 52 transports the recording medium P to the ink fixing part 20 while winding the recording medium P around the circumferential surface. In addition, a large number of adsorption holes (suction holes) (not illustrated) are provided in the circumferential surface of the image recording drum 52 in a predetermined pattern. The recording medium P wound around the circumferential surface of the image recording drum 52 is suctioned through the adsorption holes and thus can be transported while being adsorbed and held onto the circumferential surface of the image recording drum 52. Accordingly, the recording medium P can be transported with high smoothness.

In addition, in the image recording drum 52 in this embodiment, the grippers 52A are disposed at two points on the outer circumferential surface and can transport two recording media P by one rotation. Rotation of the image recording drum 52 and the processing liquid drying drum 46 is controlled so as to cause reception and delivery timings of the recording medium P of the two to be coincident with each other. That is, the image recording drum 52 and the processing liquid drying drum 46 are driven while causing the circumferential speeds thereof to be coincident with each other and are driven while causing the positions of the grippers 46A and 52A thereof to be coincident with each other.

The recording medium pressing roll 54 is disposed in the vicinity of a reception position (a position at which the recording medium P is received from the processing liquid drying drum 46) of the recording medium P of the image recording drum 52. The recording medium pressing roll 54 is configured as, for example, a rubber roll and is installed to conic into pressing contact with the circumferential surface of the image recording drum 52. The recording medium P delivered from the processing liquid drying drum 46 to the image recording drum 52 is nipped by passing through the recording medium pressing roll 54 and thus comes into close contact with the circumferential surface of the image recording drum 52.

The four ink jet heads 56M, 56K, 56C, and 56Y are disposed at predetermined intervals on the outer circumferential surface of the image recording drum 52 along the transport path of the recording medium P. The ink jet head 56 of each color is configured as a line head corresponding to the recording medium width and is configured so that the nozzle surface 78 (see FIG. 3) is disposed to face the circumferential surface of the image recording drum 52. The ink jet head 56 of each color records an image on the recording medium P transported by the image recording drum 52 by jetting liquid droplets of the photocurable ink toward the image recording drum 52 from the plurality of nozzles 78A (see FIG. 3) formed in the nozzle surface 78.

The inline sensor 58 is installed closer to the downstream side than the rearmost ink jet head 56K in the transport direction of the recording medium P transported by the image recording drum 52 and is configured to read the image recorded by the ink jet head 56 of each color. The inline sensor 58 is configured as, for example, a line scanner.

In addition, on the downstream side of the inline sensor 58, a contact prevention plate 59 installed close to the inline sensor 58 is provided. The contact prevention plate 59 can prevent contact between the inline sensor 58 and the recording medium P in a case where lifting, folding, or the like of the recording medium P occurs due to transport problems or the like.

The mist filter 60 is disposed between the rearmost ink jet head 56Y and the inline sensor 58 and captures ink mist by suctioning air in the vicinity of the image recording drum 52. By capturing the ink mist, infiltration of the ink mist into the inline sensor 58 is prevented, and occurrence of image reading failure or the like is effectively prevented.

The drum cooling unit 62 is configured to cool the image recording drum 52 by blowing cold air toward the image recording drum 52. The drum cooling unit 62 is mainly constituted by an air conditioner (not illustrated) and a duct 62A through which the cold air supplied from the air conditioner is blown toward the circumferential surface of the image recording drum 52. The duct 62A is configured to cool the image recording drum 52 by blowing cold air toward the image recording drum 52 in a region other than a transport region of the recording medium P. In this embodiment, since the recording medium P is transported along the arc-shaped outer circumferential surface of substantially the upper half of the image recording drum 52, the duct 62A cools the image recording drum 52 by blowing cold air toward a region of substantially the lower half of the image recording drum 52. Specifically, outlets (not illustrated) of the duct 62A are arranged in an arc shape so as to cover substantially the lower half of the image recording drum 52.

Figure 2:
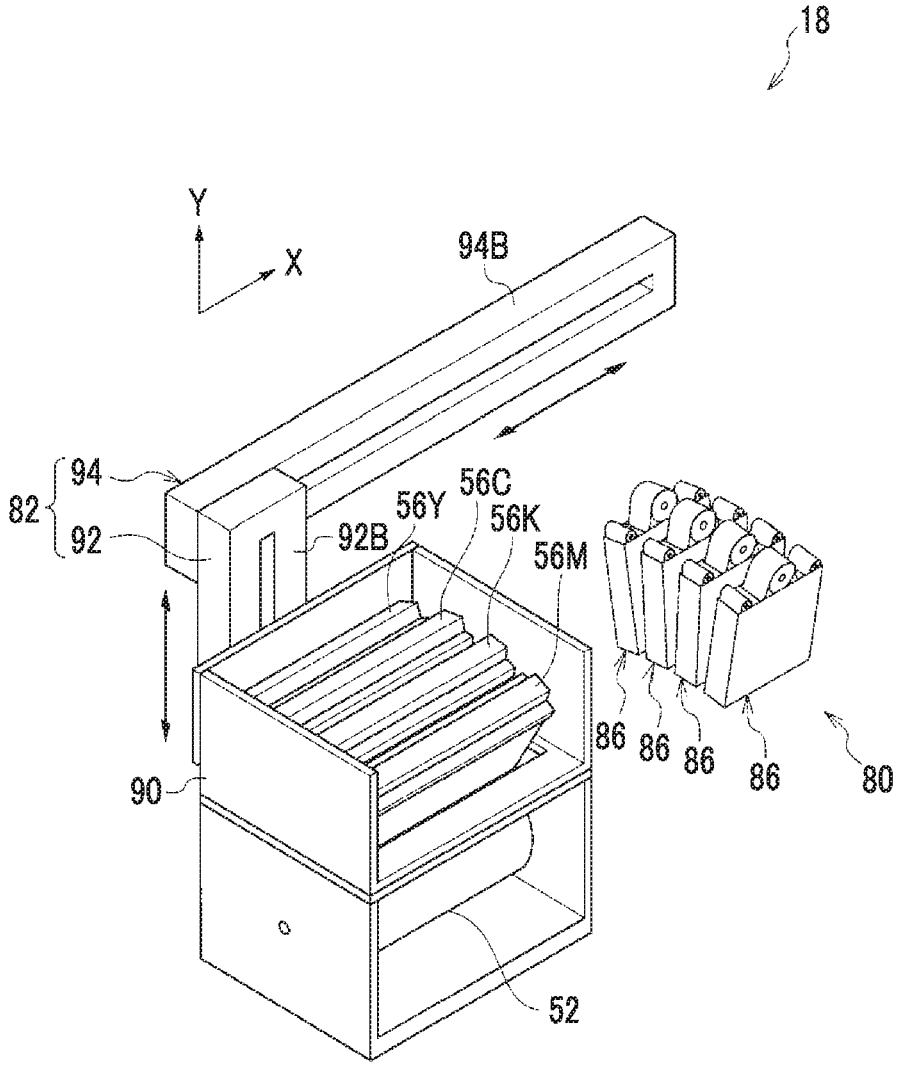
FIG. 2 is a perspective view illustrating a wiping mechanism according to the embodiment.

Furthermore, the image recording part 18 has a wiping mechanism 80 which wipes the nozzle surface 78 of the ink jet head 56 of each color as illustrated in FIG. 2. In addition, a specific configuration of the wiping mechanism 80 will be described later.

(Ink Fixing Part 20)

The ink fixing part 20 is configured to perform post-processing on the recording medium P after the image recording by removing liquid components remaining on the image recording surface of the recording medium P. As illustrated in FIG. 1, the ink fixing part 20 is provided with a chain gripper 64 which transport the recording medium P on which an image is recorded, a back tension applying mechanism 66 which applies back tension to the recording medium P transported by the chain gripper 64, and the drying part 21 and the light irradiation part 22 as the ink fixing means for fixing the recording medium P transported by the chain gripper 64.

The chain gripper 64 is used in the drying part 21, the light irradiation part and the discharge part 24 in common, and is configured to receive the recording medium P delivered from the image recording part 18 and transport the recording medium P to the discharge part 24.

The chain gripper 64 is configured to mainly include a first sprocket 64A installed close to the image recording drum 52 side, a second sprocket 64B installed on the discharge part 24 side, chains 64C as endless transport paths wound around the first sprocket 64A and the second sprocket 64B, a plurality of chain guides (not illustrated) which guide the travelling of the chain 64C, and a plurality of grippers 64D attached to the chains 64C with predetermined intervals therebetween. The first sprocket 64A, the second sprocket 64B, the chains 64C, and the chain guides form a pair on both sides in the transport width direction of the recording medium P. The gripper 64D is provided for each of the chains 64C forming a pair. The first sprocket 64A is connected to a motor (not illustrated) and is driven by rotation of the motor. The second sprocket 64B is allowed to rotate in a subordinate manner.

The back tension applying mechanism 66 is configured to apply back tension to the recording medium P transported while the leading end thereof is gripped by the chain gripper 64. Although detailed illustration of the back tension applying mechanism 66 is omitted, the back tension applying mechanism 66 mainly includes a guide plate 72, and a plurality of adsorption fans 72A as adsorption means for suctioning air from a large number of adsorption holes formed in the guide plate 72. In addition, on the lower surface of the guide plate 72, a large number of holes through which the suctioned air is discharged are provided. As the recording medium P transported by the chain gripper 64 is suctioned by the adsorption fans 72A through the adsorption holes of the guide plate 72, back tension is applied.

(Drying Part 21)

The drying part 21 is provided inside the chain gripper 64 on the upstream side in the transport direction of the chain gripper 64 and includes a plurality of drying units 68 arranged along the transport direction. The drying unit 68 is configured to blow dry wind (for example, hot wind) toward the image recording surface of the recording medium P. When dry wind is blown by the drying unit 68, the amount of moisture in the photocurable ink is reduced before irradiation of light (ultraviolet rays) by the light irradiation part 22. Accordingly, curing properties of the photocurable ink are secured by subsequent light irradiation.

(Light Irradiation Part 22)

The light irradiation part 22 is configured to irradiate the image recorded by using the photocurable ink with ultraviolet rays (UV) as light in this embodiment, thereby fixing the image. The light irradiation part 22 is configured to mainly include the chain gripper 64 which transports the recording medium P, the back tension applying mechanism 66 which applies back tension to the recording medium P and also functions as adsorption means, and irradiation units 74 which irradiate the recording medium P with light.

The irradiation units 74 are provided closer to the downstream side than the drying part 21 in the transport direction of the chain gripper 64 inside the chain gripper 64, and a plurality of the irradiation units 74 are arranged along the transport direction. The irradiation unit 74 includes an ultraviolet lamp as a light source (not illustrated). The back tension applying mechanism 66 mainly includes the guide plate 72, and the plurality of adsorption fans 72B as adsorption means for suctioning air from a large number of the adsorption holes formed in the guide plate 72. In addition, on the lower surface of the guide plate 72, a large number of holes through which the suctioned air is discharged are provided. As the recording medium P transported by the chain gripper 64 is suctioned by the adsorption fans 72B through the adsorption holes of the guide plate 72, back tension is applied.

(Discharge Part 24)

The discharge part 24 is configured to collect the recording medium P subjected to a series of image recording processes. The discharge part 24 is configured to mainly include the chain gripper 64 which transports the recording medium P on which the photocurable ink is fixed by light irradiation, and a discharge table 76 on which the recording media P are stacked and collected. Although not illustrated, the discharge table 76 is provided with sheet guards (a front sheet guide, a rear sheet guard, a transverse sheet guide, and the like) for orderly stacking the recording media P. In addition, in the discharge table 76, a discharge table elevating device (not illustrated) is provided to elevate the recording media P. The discharge table elevating device is controlled to be elevated in conjunction with variation in the recording media P collected on the discharge table 76, and is adjusted so that the recording medium P at the uppermost is always at a constant height.

(Photocurable Ink)

As the photocurable ink, for example, an aqueous ultraviolet ink which is cured by irradiation of ultraviolet rays as the light is used. The aqueous ultraviolet ink preferably includes a pigment, polymer particles, an aqueous polymerizable compound which is polymerized by active energy rays, and a photopolymerization initiator. When the aqueous ultraviolet ink is irradiated with ultraviolet rays and cured, the image obtains excellent rub resistance and the film hardness of the image increases. In addition, as the coloring material, a dye may be included.

(Wiping Mechanism 80)

As illustrated in FIG. 2, the wiping mechanism 80 includes a moving unit 82 as an example of a moving mechanism which moves the ink jet head 56, and wiping units 86 which wipe ink and the like adhered to the nozzle surface 78 (see FIG. 3) of the ink jet head 56. The wiping units 86 and the image recording drum 52 are arranged in this order in an apparatus depth direction (X direction).

(Moving Unit 82)

The moving unit 82 (an example of the moving mechanism) includes a box-shaped support member 90 which collectively supports the ink jet heads 56 of the respective colors, a vertical mechanism 92 which moves the support member 90 in a device upward direction (Y direction), and a horizontal mechanism 94 which moves the support member 90 in the apparatus depth direction (X direction).

The vertical mechanism 92 has a rail portion 92B which supports the support member 90 so as to be moved in the device upward and downward directions. In the vertical mechanism 92, the support member 90 is moved along the rail portion 92B by a driving part (not illustrated).

The horizontal mechanism 94 has a rail portion 94B which supports the rail portion 92B of the vertical mechanism 92 to be moved in the apparatus depth direction and the opposite direction thereof. In the horizontal mechanism 94, the support member 90 is moved along the rail portion 94B via the rail portion 92B by a driving part (not illustrated).

(Wiping Unit 86)

As illustrated in FIG. 2, the four wiping units 86 are provided to correspond to the ink jet heads 56 of the respective colors. As illustrated in FIG. 3, each of the wiping units 86 has a band-like wiping member 200 which comes into contact with the nozzle surface 78 of the ink jet head 56, a winding roll 114A around which the wiping member 200 is wound, a sending-out roll 114B, a counter roll 114C, and a plurality of driven rolls 116.

Furthermore, each of the wiping units 86 has a housing 112 which accommodates the wiping member 200 and the rolls 114A, 114B, 114C, and 116 described above, and an application device 110 which applies a cleaning liquid to the wiping member 200. In addition, a detailed configuration of the wiping member 200 will be described later.

The winding roll 114A, the sending-out roll 114B, the counter roll 114C are disposed in this order in an upward direction from below at the center in the apparatus depth direction (X direction) in the housing 112 and are rotatably supported in the housing 112.

One end side of the band-like wiping member 200 in the longitudinal direction thereof is wound around the sending-out roll 114B, and the other end portion thereof in the longitudinal direction is fixed to the winding roll 114A. Furthermore, as the band-like wiping member 200 is wound around the counter roll 114C and the plurality of driven rolls 116, the band-like wiping member 200 passes through a predetermined path from the sending-out roll 114B and reaches the winding roll 114A.

The winding roll 114A winds the band-like wiping member 200 by being rotated by driving force of a motor 140. The sending-out roll 114B sends out the wiping member 200 as the wiping member 200 is wound by the winding roll 114A.

The counter roll 114C is exposed to the outside from the upper side of the housing 112. In addition, the counter roll 114C supports the wiping member 200 at a position in contact with the nozzle surface 78 of the ink jet head 56 between the sending-out roll 114B and the winding roll 114A on a movement path of the wiping member 200. That is, the wiping member 200 comes into contact with the nozzle surface 78 of the ink jet head 56 moved by the moving unit 82 at a portion wound around the counter roll 114C.

In addition, the counter roll 114C and the driven rolls 116 are rotated in a subordinate manner as the wiping member 200 is moved.

The application device 110 includes ahead 128 which allows the cleaning liquid (for example, a liquid containing a surfactant) to fall dropwise, a storage tank 130 which is disposed on the lower side with respect to the head 128 and stores the cleaning liquid, and a pump 134 which pumps up the cleaning liquid from the storage tank 130 to the head 128 through a hose 132.

In the application device 110, the pump 134 pumps up the cleaning liquid from the storage tank 130 and causes the cleaning liquid to fall dropwise from the head 128 to be applied to a portion of the wiping member 200 moved between the sending-out roll 114B and the counter roll 114C.

In addition, the wiping unit 86 is detachable from the liquid droplet jetting apparatus 10 (the wiping mechanism 80) such that the wiping member 200 can be replaced.

(Wiping Member 200)

Figure 4:
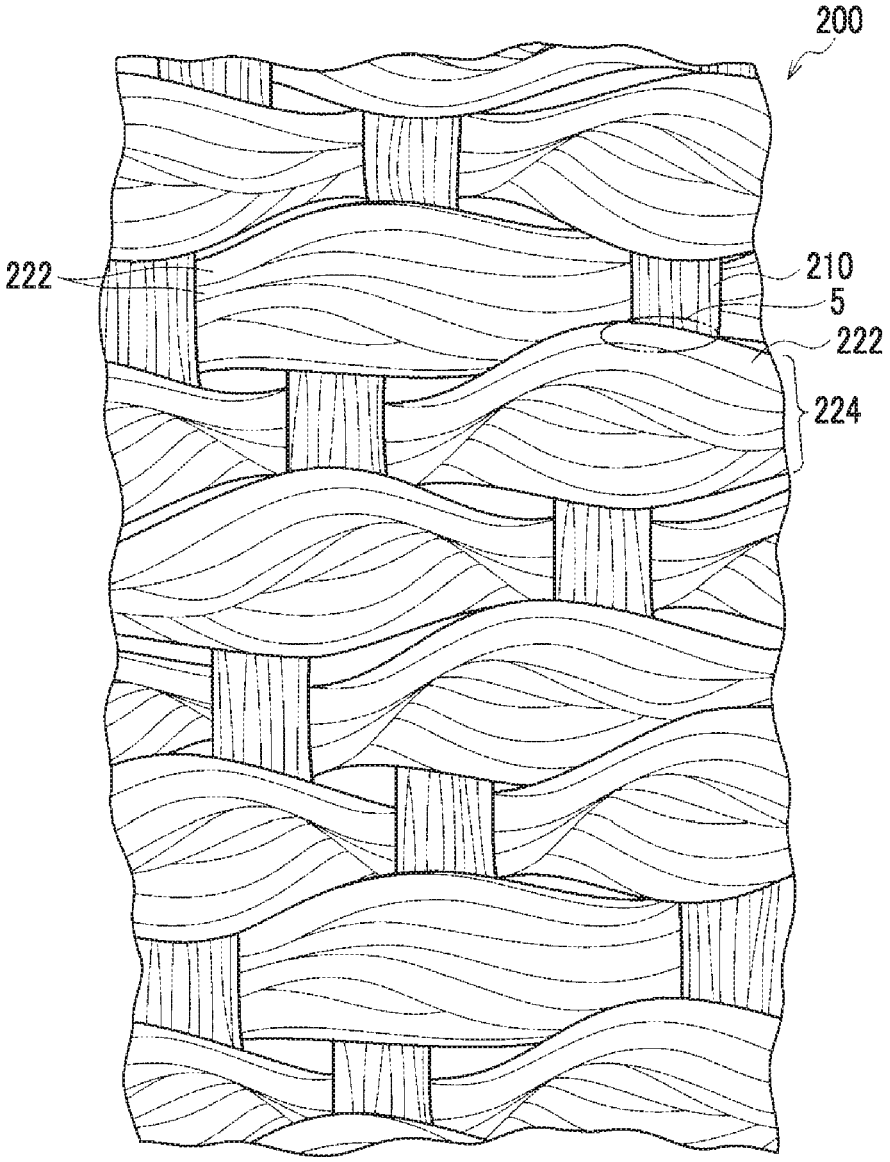
FIG. 4 is a view illustrating a wiping member according to the embodiment.
Figure 5:
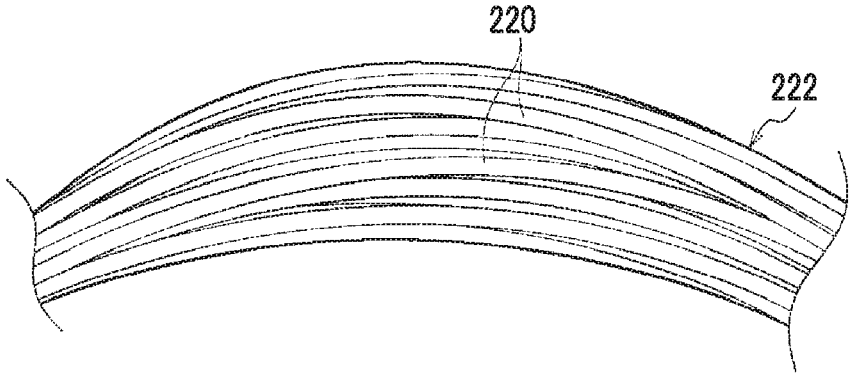
FIG. 5 is a view illustrating a weft yarn bundle according to the embodiment.

As illustrated in FIG. 4, the wiping member 200 is configured as a fabric (web) formed by weaving warp yarns 210 and weft yarns 220 (see FIG. 5) having different diameters. Specifically, a plurality (for example, tends to hundreds) of the weft yarns 220 are bound together to constitute a weft yarn bundle 222, and a plurality of the weft yarn bundles 222 constitute a weft yarn bundle bunch 224. The wiping member 200 is configured by weaving the weft yarn bundle bunches 224 and a plurality of the warp yarns 210 to cross each other. In FIG. 4, illustration of each of the weft yarns 220 constituting the weft yarn bundle is omitted. In FIG. 5, a single weft yarn bundle 222 (a portion within two-dot chain line 5 in FIG. 4) constituted by the plurality of weft yarns 220 is illustrated.

Figure 6:
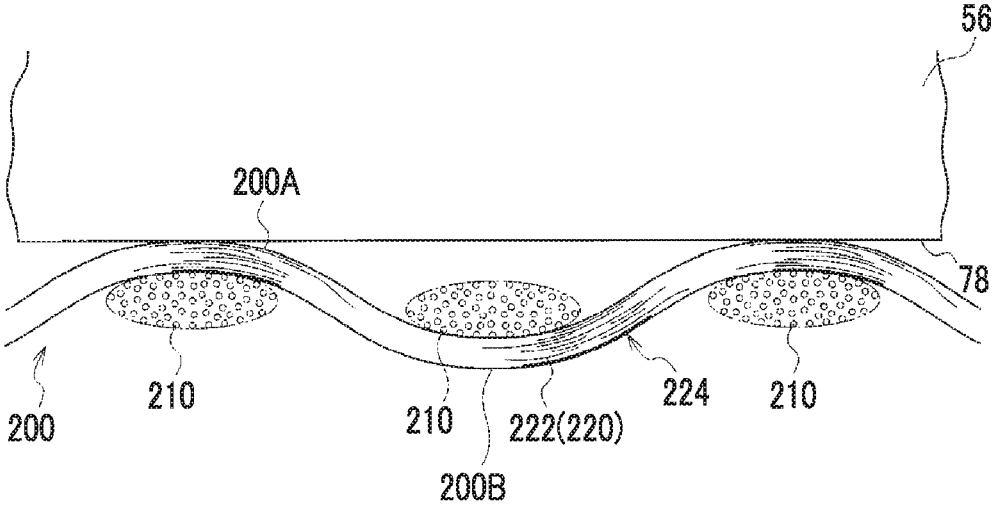
FIG. 6 is a view illustrating a portion of the wiping member according to the embodiment.

As illustrated in FIG. 6, the weft yarns 220 (the weft yarn bundle 222) are further exposed to the nozzle surface 78 than the warp yarns 210. That is, in the wiping member 200 of this embodiment, among the warp yarns 210 and the weft yarns 220, the weft yarns 220 come into contact with the nozzle surface 78. In the wiping member 200, the nozzle surface 78 is wiped by a front surface 200A (an example of one surface), and a rear surface 200B (an example of the other surface) is not used for wiping of the nozzle surface 78.

In addition, the warp yarns 210 are arranged along the direction of relative movement between the wiping member 200 and the nozzle surface 78 (inward direction in FIG. 6). That is, the weft yarns 220 intersect the relative movement direction (wiping direction). In addition, the weft yarns 220 may intersect the relative movement direction in a range of 60 degrees to 120 degrees.

Figure 7:
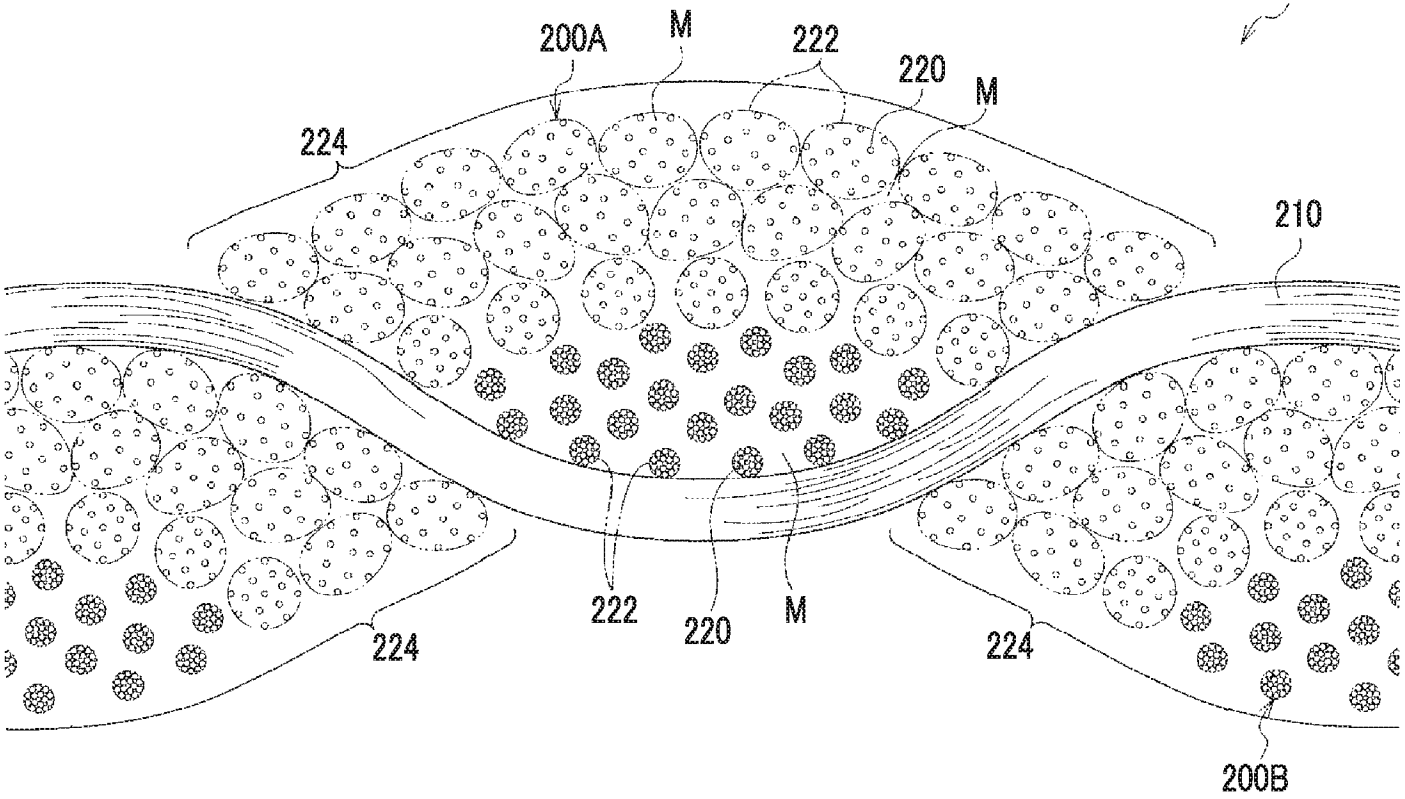
FIG. 7 is an enlarged schematic view illustrating a portion of the wiping member according to the embodiment.

As illustrated in FIG. 7, the wiping member 200 has a plurality of voids M that form capillaries between the weft yarn bundles 222 and between the weft yarns 220 in each of the weft yarn bundles 222 from the front surface 200A side to the rear surface 200B side. That is, the liquid such as ink adhered to the nozzle surface 78 is absorbed by the voids M of the wiping member 200 and is held in the voids M.

Furthermore, in the wiping member 200, the weft yarn bundles on the rear surface 200B side are bound together more densely than the weft yarn bundles 222 on the front surface 200A side, and the voids M between the weft yarn bundles 222 (between the weft yarn bundles 222) on the rear surface 200B side are greater in size than those on the front surface 200A side.

Moreover, the wiping member 200 is configured as a single member having a single layer structure other than a multi-layer structure configured by attaching a plurality of members.

In addition, for the weft yarns 220 and the warp yarns 210, as an example, polyethylene terephthalate is used.

(Other Configurations in Wiping Mechanism 80)

The wiping mechanism 80 has a configuration for notifying a user of the apparatus of a possibility of infiltration of bubbles into the nozzle 78A. Specifically, as illustrated in FIG. 3, the wiping mechanism 80 includes a measuring part 88 which measures the amount of ink adhered to the wiping member 200 that has wiped the nozzle surface 78, and a determination part 89 which determines whether or not the amount of ink measured by the measuring part 88 is equal to or more than a predetermined specified amount.

Furthermore, the wiping mechanism 80 includes a display part 87 as an example of a notification part which notifies the user of the apparatus of predetermined notification in a case where the determination part 89 determines that the amount of ink measured by the measuring part 88 is equal to or more than the predetermined specified amount.

Specifically, the measuring part 88 is configured as a sensor which irradiates the wiping member 200 after wiping the nozzle surface 78 with light and detects the amount of light passing through the wiping member 200. The measuring part 88 is disposed on the downstream side of the counter roll 114C in the movement path of the wiping member 200, and has a light-emitting section 88A and a light-receiving section 88B. The light-emitting section 88A irradiates the wiping member 200 passing through the counter roll 114C with light. The light-receiving section 88B receives the light which is emitted from the light-emitting. section 88A and passes through the wiping member 200. The measuring part 88 measures the amount of ink adhered to the wiping member 200 by measuring the amount of light incident on the light-receiving section 88B. That is, the measuring part 88 measures the amount of ink by using the fact that when the amount of ink adhered to the wiping member 200 increases, the light from the light-emitting section 88A is blocked by the ink and the amount of light received by the light-receiving section 88B decreases.

Here, the amount of ink adhered to the wiping member 200 is measured to indirectly measure the amount of ink drawn from the nozzle 78A because the amount of ink adhered to the wiping member 200 increases as the amount of ink drawn from the nozzle 78A by the wiping member 200 absorbing the ink increases. In addition, when the ink is drawn from the nozzle 78A by the wiping member 200, bubbles infiltrate into the space. Accordingly, as the amount of ink drawn from the nozzle 78A increases, bubbles infiltrate into the nozzle 78A. Therefore, as the amount of ink adhered to the wiping member 200 increases, there is a higher possibility of infiltration of bubbles into the nozzle 78A.

In addition, information regarding the amount of light detected by the measuring part 88 is sent to the determination part 89, and the determination part 89 determines whether or not the amount of light detected by the measuring part 88 is equal to or less than the predetermined specified amount. In a case where the determination part 89 determines that the amount of light detected by the measuring part 88 is equal to or less than the predetermined specified value, the determination part 89 sends a display command to the display part 87.

The display part 87 performs predetermined displaying in order to notify the user of the apparatus based on the display command. The display part 87 displays, as a predetermined display, for example, an instruction to replace the wiping unit 86 (wiping member 200), an instruction to check whether or not streaks are present in the recording medium P on which an image is formed, or the like. In addition, streaks in the recording medium P are caused by jetting failure of ink caused by infiltration of bubbles into the nozzle 78A.

(Maintenance Mode of Liquid Droplet Jetting Apparatus 10)

The liquid droplet jetting apparatus 10 has, as a maintenance mode (maintenance method), a wiping mode in which the nozzle surface 78 is wiped by moving the wiping member 200 relative to the nozzle surface 78.

Furthermore, the liquid droplet jetting apparatus 10, as the maintenance mode (maintenance method), a purge wiping mode in which a purging operation and a wiping operation of wiping the nozzle surface 78 are performed. In the purge wiping mode, in order to remove bubbles in the ink, thickened ink, and the like, the purging operation of discharging ink from all the nozzles 78A is performed, and after performing the purging operation, the nozzle surface 78 is wiped by moving the wiping member 200 relative to the nozzle surface 78.

(Action of This Embodiment)

Next, as an action of this embodiment, a wiping method in the purge wiping mode will be described.

In the wiping method in the purge wiping mode, first, in order to remove bubbles in the ink, thickened ink, and the like, the purging operation of discharging ink from all the nozzles 78A is performed. In addition in the purging operation, the ink is jetted onto a receiving part (not illustrated) which receives the ink.

Next, as illustrated in FIG. 3, the pump 134 of the application device 110 of each of the wiping units 86 is driven to pump up the cleaning liquid from the storage tank 130 and causes the cleaning liquid to fall dropwise from the head 128 onto the wiping member 200 so as to be applied thereto.

Next, as the wiping member 200 is wound by the winding roll 114A by driving the motor 140 of each of the wiping units 86, a portion of the wiping member 200 to which the cleaning liquid is applied is moved toward the counter roll 114C. Accordingly, the portion of the wiping member 200 to which the cleaning liquid is applied is moved to a position where the portion is wound around the counter roll 114C, that is, a position here the portion can come into contact with the nozzle surface 78.

Next, the ink jet head 56 is moved in the apparatus depth direction (in the X direction) by the moving unit 82. Due to the movement of the ink jet head 56 in the apparatus depth direction, the portion of the wiping member 200 wound around the counter roll 114C starts to come into contact with the nozzle surface 78 of the ink jet head 56. As the ink jet head 56 is moved in the apparatus depth direction, the position where the nozzle surface 78 of the ink jet head 56 comes into contact with the wiping member 200 can be changed, and the nozzle surface 78 is wiped by the wiping member 200. Accordingly, ink adhered to the nozzle surface 78 is removed. Here, while the wiping member 200 comes into contact with the nozzle surface 78 of the ink jet head 56, the wiping member 200 may be moved by driving the motor 140 of the wiping unit 86 simultaneously with the movement of the ink jet head 56 in the apparatus depth direction Accordingly it becomes possible to wipe the nozzle surface 78 with a fresh surface which does not perform wiping.

As described above, in the purge wiping mode, since the wiping operation of wiping the nozzle surface 78 is performed after the purging operation is performed, ink adhered to the nozzle surface 78 can be suitably removed by the purging operation. In addition, in the wiping mode, the purging operation is not performed, and only the wiping operation is performed. Here, the movement speed of the ink jet head 56 in the apparatus depth direction, the movement speed of the wiping member 200, and the like vary between the wiping mode and the purge wiping mode.

Here, according to the configuration of this embodiment, the voids M positioned on the front surface 200A side of the wiping member 200 which comes into contact with the nozzle surface 78 are smaller in size than the voids M positioned on the rear surface 200B side. Therefore, compared to a case where the size of the voids M on the front surface 200A side is equal to or greater than the size of the voids M on the rear surface 200B side, the suction force acting on the ink in the nozzle 78A decreases. Accordingly, the ink in the nozzle 78A is not absorbed more than necessary, and infiltration of bubbles into the nozzle 78A can be prevented.

In addition, in the configuration of this embodiment, since the voids on the rear surface 200B side are greater in size than the voids M on the front surface 200A side, compared to a case where the size of the voids M on the rear surface 200B side is equal to or smaller than the size of the voids M on the front surface 200A side, a large amount of ink moved from the front surface 200A side can be absorbed.

As described above, in the configuration of this embodiment, while infiltration of bubbles into the nozzle 78A is prevented when the nozzle surface 78 is wiped by the wiping member 200, the absorption capacity of the wiping member 200 which absorbs the ink adhered to the nozzle surface 78 can be secured.

In addition, in the configuration of this embodiment, since the wiping member 200 has a single layer structure, there is no boundary between layers, unlike the multi-layer structure. Therefore, a change in the suction force of the ink, which occurs at the boundary when the ink is suctioned from the front surface 200A side toward the rear surface 200B side beyond the boundary in the case of the multi-layer structure, does not occur. Therefore, the suction force acting on the ink in the nozzle 78A is maintained at a low level, so that infiltration of bubbles into the nozzle 78A can be prevented.

In addition, in the configuration of this embodiment, the weft yarn bundles 222 on the rear surface 200B side can be bound together more densely than the weft yarn bundles 222 on the front surface 200A side, and the voids M between the weft yarn bundles 222 are greater in size on the rear surface 200B side than those on the front surface 200A side. As described above, by causing methods of binding yarn bundles to be different between the weft yarn bundles 222 on the rear surface 200B side and the weft yarn bundles 222 on the front surface 200A side, the sizes of the voids M are adjusted. Therefore, with a simple configuration, the sizes of the voids M on the front surface 200A side and on the rear surface 200B side of the wiping member 200 can be caused to be different from each other.

Furthermore, in this embodiment, in a case where in a case where the amount of ink adhered to the wiping member 200 after wiping is equal to or more than the specified amount, predetermined notification is notified to the user of the apparatus. Accordingly, a possibility of infiltration of bubbles into the nozzle 78A can be notified to the user of the apparatus. Specifically, for example, displaying for prompting the user to check the presence or absence of streaks formed on the recording medium P due to ink jetting failure caused by infiltration of bubbles into the nozzle 78A can be performed.

In this embodiment, as described above, since infiltration of bubbles into the nozzle 78A can be prevented, image failure such as streaks occurring on the recording medium P due to ink jetting failure (non-jetting, bending in the jetting direction, and the like) caused by infiltration of bubbles into the nozzle 78A can be prevented. In addition, as described above, since the absorption capacity of the wiping member 200 is secured, unwiped portions of the nozzle surface 78 of the ink jet head 56 can be prevented.

(Modification Example of Measuring Part 88)

In the embodiment described above, the measuring part 88 is configured as a sensor that irradiates the wiping member 200 with light after the nozzle surface 78 is wiped and detects the amount of light passing through the wiping member 200, but it not limited thereto. For example, as the measuring part 88, an imaging device (for example, a camera or microscope) which images the surface of the wiping member 200 may be used. In this configuration, for example, light which is reflected on the wiping member 200 and is incident on the measuring part 88 is converted into an electrical signal by an imaging element, and the amount of ink can be measured by the signal value. Specifically, for example, in a case where the wiping member 200 is white and the ink is magenta, the green component of the light is absorbed by the ink, and the green component of the light incident on the measuring part 88 decreases. Therefore, when the amount of ink adhered to the wiping member 200 increases, a signal value corresponding to the green component decreases. In addition, information regarding the signal value generated by the measuring part 88 is transmitted to the determination part 89, and the determination part 89 determines whether or not the signal value generated by the measuring part 88 is equal to or lower than a predetermined specified value. In a case where the determination part 89 determines that the signal value generated by the measuring part 88 is equal to or lower than the predetermined specified value, the determination part 89 transmits a display command to the display part 87.

Furthermore, as the measuring part 88, an analysis device which analyzes the components of the ink adhered to the wiping member 200. In this configuration, the wiping member 200 is advanced into the analysis device, and the amount of the ink components (for example, pigment) are measured. That is, in this configuration, the amount of ink is measured by using the fact that as the amount of ink adhered to the wiping member 200 increases, the amount of the ink components increases. In addition, information regarding the amount of the components measured by the measuring part 88 is transmitted to the determination part 89, and the determination part 89 determines whether or not the amount of the components measured by the measuring part 88 is equal to or more than a predetermined specified amount. In a case where the determination part 89 determines that the amount of the components measured by the measuring part 88 is equal to or more than the predetermined specified amount, the determination part 89 transmits a display command to the display part 87.

(Other Modification Examples)

In the embodiment described above, the wiping member 200 is configured by weaving the weft yarn bundle bunches 224 and the plurality of warp yarns 210, but is not limited thereto. For example, a porous member such as a sponge (foamed body) may be used.

In addition, in the embodiment described above, the display part 87 which performs predetermined displaying is used as an example of the notification part which notifies predetermined notification to the user of the apparatus. However, the notification part is not limited thereto. As the notification part, for example, the user of the apparatus may be notified by a method other than displaying (for example, sound).

In addition, in the embodiment described above, as the liquid droplet jetting apparatus for jetting liquid droplets, an ink jet apparatus which records an image by jetting ink droplets has been described. However, the liquid droplet jetting apparatus is not limited thereto. For example, the present invention can be applied to any liquid droplet jetting apparatus used industrially, such as an apparatus which produces a display color filter by jetting ink onto a polymer film or glass, or an apparatus which forms bumps for mounting components by jetting solder in a welded state onto a substrate.

In addition, in the embodiment described above, the wiping member 200 and the ink jet head 56 are moved relative to each other by moving the ink jet head 56 using the moving unit 82. However, the embodiment is not limited thereto. For example, the wiping member 200 and the ink jet head 56 may be moved relative to each other by moving the wiping units 86 using the moving mechanism. Furthermore, the wiping member 200 and the ink jet head 56 may be moved relative to each other by individually moving the wiping units 86 and the ink jet head 56 using the moving mechanism.

In addition, in the embodiment described above, the wiping member 200 and the ink jet head 56 are moved relative to each other by moving the ink jet head 56 with the driving force of the moving unit 82. However, the embodiment is not limited thereto. For example, the wiping member 200 and the ink jet head 56 may be moved relative to each other by manually moving the wiping member 200.

The present invention is riot limited to the above-described embodiments, and various modifications, changes, and improvements can be made in a scope without departing from the gist thereof. For example, a plurality of the above-described modification examples may be appropriately combined.

EXPLANATION OF REFERENCES

10: liquid droplet jetting apparatus
56: ink jet head (example of liquid droplet jetting head)
78A: nozzle
78: nozzle surface
80: wiping mechanism
82: moving unit (example of moving mechanism)
87: display part (example of notification part)
88: measuring part
200: wiping member
222: weft yarn bundle (example of yarn bundle)
M: void

What is claimed is:

1. A wiping mechanism comprising:

a wiping member which has one surface that comes into contact with a nozzle surface with a nozzle through which liquid droplets are jetted, and has a plurality of voids that form capillaries from the one surface side to the other surface side, the voids being greater in size on the other surface side than on the one surface side; and a moving mechanism which moves the wiping member relative to the nozzle surface, wherein the wiping member is formed by weaving yarn bundles configured by binding yarns, the yarn bundles on the other surface side are bound together more densely than the yarn bundles on the one surface side, and the voids between the yarn bundles are greater in size on the other surface side than on the one surface side.

2. The wiping mechanism according to claim 1, wherein the wiping member has a single layer structure.

3. The wiping mechanism according to claim 1, further comprising:

a measuring part which measures the amount of liquid adhered to the wiping member that has wiped the nozzle surface; and a notification part which notifies predetermined notification to a user of an apparatus in a case where the amount of the liquid measured by the measuring part is equal to or more than a specified amount.

4. The wiping mechanism according to claim 2, further comprising:

a measuring part which measures the amount of liquid adhered to the wiping member that has wiped the nozzle surface; and a notification part which notifies predetermined notification to a user of an apparatus in a case where the amount of the liquid measured by the measuring part is equal to or more than a specified amount.

5. A liquid droplet jetting apparatus comprising:

a liquid droplet jetting head having a nozzle surface with a nozzle through which liquid droplets are jetted; and the wiping mechanism according to claim 1, which wipes the nozzle surface of the liquid droplet jetting head with the wiping member.

6. A liquid droplet jetting apparatus comprising:

a liquid droplet jetting head having a nozzle surface with a nozzle through which liquid droplets are jetted; and the wiping mechanism according to claim 2, which wipes the nozzle surface of the liquid droplet jetting head with the wiping member.

7. A liquid droplet jetting apparatus comprising:

a liquid droplet jetting head having a nozzle surface with a nozzle through which liquid droplets are jetted; and the wiping mechanism according to claim 3, which wipes the nozzle surface of the liquid droplet jetting head with the wiping member.

8. A liquid droplet jetting apparatus comprising:

a liquid droplet jetting head having a nozzle surface with a nozzle through which liquid droplets are jetted; and the wiping mechanism according to claim 4, which wipes the nozzle surface of the liquid droplet jetting head with the wiping member.

9. The liquid droplet jetting apparatus according to claim 5, wherein the liquid droplet jetting apparatus has a wiping mode in which the nozzle surface is wiped by moving the wiping member relative to the nozzle surface, and a purge wiping mode in which a purging operation of jetting a liquid from all the nozzles is performed, and after the purging operation is performed, the nozzle surface is wiped by moving the wiping member relative to the nozzle surface.

10. The liquid droplet jetting apparatus according to claim 6, wherein the liquid droplet jetting apparatus has a wiping mode in which the nozzle surface is wiped by moving the wiping member relative to the nozzle surface, and a purge wiping mode in which a purging operation of jetting a liquid from all the nozzles is performed, and after the purging operation is performed, the nozzle surface is wiped by moving the wiping member relative to the nozzle surface.

11. The liquid droplet jetting apparatus according to claim 7, wherein the liquid droplet jetting apparatus has a wiping mode in which the nozzle surface is wiped by moving the wiping member relative to the nozzle surface, and a purge wiping mode in which a purging operation of jetting a liquid from all the nozzles is performed, and after the purging operation is performed, the nozzle surface is wiped by moving the wiping member relative to the nozzle surface.

12. The liquid droplet jetting apparatus according to claim 8, wherein the liquid droplet jetting apparatus has a wiping mode in which the nozzle surface is wiped by moving the wiping member relative to the nozzle surface, and a purge wiping mode in which a purging operation of jetting a liquid from all the nozzles is performed, and after the purging operation is performed, the nozzle surface is wiped by moving the wiping member relative to the nozzle surface.

13. A wiping method comprising:

moving a wiping member, which has one surface that comes into contact with a nozzle surface with a nozzle through which liquid droplets are jetted, and has a plurality of voids that form capillaries from the one surface side to the other surface side, the voids being greater in size on the other surface side than on the one surface side, relative to the nozzle surface, wherein the wiping member in which the wiping member is formed by weaving yarn bundles configured by binding yarns, the yarn bundles on the other surface side are bound together more densely than the yarn bundles on the one surface side, and the voids between the yarn bundles are greater in size on the other surface side than on the one surface side, is used.

14. The wiping method according to claim 13, wherein the wiping member which has a single layer structure is used.

* * * * *